US009285133B2

(12) United States Patent
Schneider et al.

(10) Patent No.: US 9,285,133 B2
(45) Date of Patent: Mar. 15, 2016

(54) AIR HUMIDIFICATION SYSTEM

(71) Applicant: Air System Components, Inc., Plano, TX (US)

(72) Inventors: Stephen M. Schneider, Holly Springs, NC (US); Mitchell A. Karl, Fuquay-Varina, NC (US); Ronald W. Graves, Sanford, NC (US)

(73) Assignee: AIR SYSTEM COMPONENTS, INC., Plano, TX (US)

( * ) Notice: Subject to any disclaimer, the term of this patent is extended or adjusted under 35 U.S.C. 154(b) by 417 days.

(21) Appl. No.: 13/745,566

(22) Filed: Jan. 18, 2013

(65) Prior Publication Data

US 2013/0186611 A1 Jul. 25, 2013

Related U.S. Application Data

(60) Provisional application No. 61/589,326, filed on Jan. 21, 2012.

(51) Int. Cl.

| | |
|---|---|
| ***F24F 6/04*** | (2006.01) |
| ***B01F 3/04*** | (2006.01) |
| ***F24F 11/00*** | (2006.01) |

(52) U.S. Cl.

CPC ..... *F24F 11/0008* (2013.01); *B01F 3/04085* (2013.01); *F24F 6/04* (2013.01); *F24F 6/043* (2013.01)

(58) Field of Classification Search

CPC .... B01F 3/04; B01F 3/04007; B01F 3/04085; F24F 6/04

USPC ..... 261/26, 34.1, 39.1, 66, 94, 97, 99, 100, 261/106; 95/1, 14, 16; 236/44 A

See application file for complete search history.

(56) References Cited

U.S. PATENT DOCUMENTS

| | | | | |
|---|---|---|---|---|
| 4,851,162 | A * | 7/1989 | Sperr, Jr. | F24F 6/04 261/105 |
| 6,000,684 | A | 12/1999 | Pasch et al. | |
| 6,354,572 | B1 | 3/2002 | Menassa | |
| 6,394,427 | B1 | 5/2002 | Guetersloh et al. | |
| 6,622,993 | B2 | 9/2003 | Mulvaney | |
| 7,131,639 | B2 * | 11/2006 | Kammerzell et al. | 261/96 |

(Continued)

OTHER PUBLICATIONS

Trion Inc, "Herrmidifier G-100ES Duct Mount Humidifier, Installation, Operation, Maintenance," brochure, Jan. 2009.

(Continued)

*Primary Examiner* — Robert A Hopkins

(74) *Attorney, Agent, or Firm* — Jackson Walker LLP; Christopher J. Rourk

(57) ABSTRACT

A humidifier for use in a central HVAC duct. The humidifier includes a water delivery system for applying water to an evaporator pad, a drain system for removing excess water that is not evaporated, and a control system employing two temperature sensors directly measuring the temperature of the air before and after the evaporator pad. The control system uses the two temperatures to adjust the water flow across the pad by cycling the water delivery system so that drain water is minimized while maximizing the evaporative capacity of the humidifier thus satisfying the humidification load as quickly as possible with the least amount of drain water. The humidifier may have either an integral fan or a flow-through housing for passing air across the wetted evaporator pad to increase the humidity level of the air.

20 Claims, 8 Drawing Sheets

(56) References Cited

U.S. PATENT DOCUMENTS

| | | | |
|---|---|---|---|
| 2011/0067851 | A1 | 3/2011 | Terlson et al. |
| 2011/0068486 | A1 | 3/2011 | Quam et al. |
| 2011/0068488 | A1 | 3/2011 | Cao et al. |
| 2011/0068489 | A1 | 3/2011 | Terlson et al. |
| 2011/0068490 | A1 | 3/2011 | Wang et al. |
| 2011/0068491 | A1 | 3/2011 | Wang et al. |

OTHER PUBLICATIONS

Honeywell, "TrueEASE™ Evaporative Humidification Systems," brochure, Jul. 2010.

* cited by examiner

AIR HUMIDIFICATION SYSTEM

BACKGROUND OF THE INVENTION

1. Field of the Invention

This invention relates generally to air humidifiers such as used in a central HVAC system, more particularly to a water-saving humidifier control, and specifically to an air humidifier control system based on temperature differential which maintains minimal drain water with maximal humidification output regardless of environmental conditions.

2. Description of the Prior Art

Humidifiers have become integral components in residential and commercial heating, ventilating and air-conditioning ("HVAC") systems. Typical central HVAC systems comprise a duct system in combination with a blower or fan and controls for selective or constant circulation of air through the duct system. Heating components are utilized to provide an influx of heat upon demand or as a function of the overall HVAC system. The energy present in the air, added by the heating system, is used to evaporate water from the humidifier. Typically, the evaporator pad is wetted by introducing water at the top of the evaporator pad and allowing water to saturate the pad thoroughly. The force of gravity causes the water to flow through the evaporator pad toward a drain opening. While water is flowing through the evaporator pad, warm air is circulated either through a by-pass duct or by means of a fan or blower that is integral to the humidifier. This warm air increases the rate of evaporation of water from the evaporator pad and the humidity of the air is increased.

Typical conventional flow-through humidifiers merely supply the water to the pad at a constant flow rate as long as humidity is being called for. Generally, not all of the water evaporates, and the remainder flows through the pad and is emptied through the drain section of the typical humidifier. The drained water is wasteful and costly. A typical wetted-pad, flow-through humidifier today can have drain water to evaporation ratios exceeding five gallons of drain water to every one gallon of water evaporated into the HVAC system.

Moreover, the waste of water by the typical "constant" water-flow humidifier is generally not constant. A number of variables may aggravate the waste of water. Anything that acts to reduce the output capacity of the humidifier can likewise increase the waste of water in a constant flow system. Reductions in the surface area and/or size of the evaporator pad, degradation of the physical condition of the evaporator pad, reductions in the flow rate of air through the evaporator pad, and reductions in the temperature of the air flowing through the evaporator pad can all reduce the capacity of the humidifier and therefore increase the amount of wasted water. Except maybe for the size of the evaporator pad, all of these items are variable and dependent upon the specific conditions of the system at any specific time and may also vary with the seasons and environment.

Other variables can cause the performance of a typical flow-through humidifier to vary from application to application. The flow rate of the water may not really be constant in different locations, since it is dependent, for example, upon the water pressure supplied to the humidifier. Systems provided with higher than typical water pressure may not operate at a maximum output potential due to excessive water flowing through the evaporator pad, i.e., flooding of the pad. This condition can reduce the effectiveness of the humidifier and waste even more water. Air flow rates and temperatures are not the same in all applications, which makes humidifier performance and water waste dependent on location and application. Unless the humidifier has an integral fan or blower, the flow rate of the warm air across the evaporator pad is highly dependent on location and application. More and/or warmer air flow will result in more evaporation and, thus more humidification capacity. Some HVAC systems include filtration systems which become dirty, resulting in reduced air flow. This would result in diminished airflow and evaporation and increase the amount of water wasted. The temperature of the air flowing through the evaporator pad is also crucial to the rate of evaporation, and air temperature can depend on the HVAC installation, its environment, and other factors. The type of heat source may effect air temperature and flow rate. In gas-fired systems, gas pressure fluctuations, dirty heat exchangers, and variations in the calorific value of the gas being burned all create a variable amount of heat being delivered to the air. Variable speed blowers naturally make constant water flow humidifiers subject to variations in efficiency and waste water flow. This uncertainty makes humidifier drain waste and output ratings (typically a single number of gallons per day) somewhat unreliable, especially for predicting the amount of waste water generated by the system.

Several known methods have been employed to reduce the drain water discharged from air humidification systems. U.S. Pat. No. 6,354,572 to Menassa discloses one type of humidifier utilizing a constant time interval pulsing of the water valve to reduce the total flow rate of water through the evaporator pad so that the evaporation rate may more closely match the output capacity or potential of a given pad size. This method, while simple, may result in some water savings, but it cannot maintain an optimal output capacity while saving water concurrently. The time interval may be tuned or optimized for one specific set of HVAC system conditions (air temperature, water pressure, air flow rate, etc.), but a system like this cannot automatically adjust the flow rate of water across the pad to account for any of the conditions affecting performance mentioned above. Thus, time-based humidification systems may save water compared to a typical continuous-flow humidification system, but the humidification output and waste water results still vary for each different HVAC system condition and are not optimal.

U.S. Pat. No. 6,622,993 to Mulvaney discloses another type of humidifier which employs a wick-like evaporator pad construction and a reservoir pan equipped with a water level switch so that supply water delivery is ceased when the level switch is activated. The result is a humidifier that does not waste any water or just a negligible amount. At the beginning of operation this "drainless" humidification system may introduce a constant flow of water into the reservoir where it wicks into the pad. Upon filling the reservoir, a water level switch will close and act to cease delivery of water to the evaporator pad. As water evaporates, water "wicks" up the pad until the level switch opens and allows more water to flow across the pad. This cycle repeats until there is no longer a demand for humidification. This method ensures that no waste water will drain from the humidifier, or only a minimal amount, but it may cause premature coating of the pad with minerals requiring more frequent pad replacement. Another weakness of this method is the capacity fluctuations that will occur while the water supply is not operating and the pad is "wicking". Over time, as the pad is coated with minerals, its ability to "wick" will begin to diminish and the output of the humidifier will decrease. Yet another weakness relates to the use of a reservoir pan. The pan allows water to stand for extended periods of time and may allow the growth of bacterial microbes that may enter the airstream on subsequent operation cycles. These drainless humidification systems may save water compared to a typical flow-through humidification system, but output capacity is wholly dependent upon the condition of the evaporator pad due to the wicking action that is required.

SUMMARY

The present invention is directed to systems and methods which provide a humidifier with maximum output, but with very low or minimal drain water that is approximately proportional to the output. The present invention also provides a humidifier that can automatically adapt to changes in the system or environment to maintain maximum output with minimal drain water in approximately the same proportion.

The invention is directed to a humidifier having an evaporator pad, a water delivery valve, and a water delivery controller which monitors the temperature drop of an air flow across the evaporative pad, determines whether the temperature drop is increasing or decreasing, determines the maximum temperature drop thus far during a call for humidity, opens the valve when the temperature drop is decreasing and is less than or equal to a predetermined fraction of the maximum temperature drop thus far, and closes the valve when the temperature drop is increasing.

The controller may obtain the temperature drop from a temperature sensor upstream of the pad and a temperature sensor downstream of the pad.

The humidifier is preferably of the flow-through design with a drain system, with the housing directing an air flow through the pad, and the water delivery system supplying water to the pad, and the drain system removing excess water from the humidifier.

The predetermined fraction may range from 0.01, or 0.1, or 0.4, or 0.7 up to 0.99, or 0.95, or 0.9. The controller may have more than one predetermined fraction, each of the fractions active during a different set of operating conditions. The controller may automatically adjust the predetermined fraction for different operating conditions.

The invention is also directed to a method of controlling water delivery to an evaporative pad in an air humidifier. During a call for humidity, the method involves monitoring the temperature drop of the air flow across the evaporative pad, determining whether the temperature drop is increasing or decreasing, determining the maximum temperature drop thus far during the call for humidity, opening a control valve which supplies water to the pad when the temperature drop is decreasing and is less than or equal to a predetermined fraction of the maximum temperature drop, and closing the control valve when the temperature drop is increasing.

Embodiments of the invention thus provide a residential or commercial humidifier for use in a central HVAC duct to increase the humidity level of the air passing across a wetted evaporator pad. The humidifier may have either an integral fan or a flow-through or by-pass housing for passing air across the pad. The control system adjusts the water flow across the pad so that drain water is minimized while maximizing the evaporative capacity of the humidifier in an effort to satisfy the humidification load as quickly as possible with the least amount of drain water.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

The accompanying drawings, which are incorporated in and form part of the specification in which like numerals designate like parts, illustrate embodiments of the present invention and together with the description, serve to explain the principles of the invention. In the drawings.

DETAILED DESCRIPTION

The invention consists of an air humidification system employing a housing to contain all of the parts, an evaporator pad, a water delivery system to deliver water to the evaporator pad, a drain system to allow excess water to flow away from the humidification system, temperature sensors to measure the air temperature being supplied to the humidification system and the temperature of the air flowing out of the humidification system, and a control system to operate the electrical portions of the system. The control system controls water flow to the pad to maintain the temperature differential of the air upstream and downstream of the pad near its maximum value. At the same time the control system uses a small amount of water, maintaining a small amount of drain water flow in proportion to the output. Other optional features may be included, some of which will be described herein.

Figure 1:
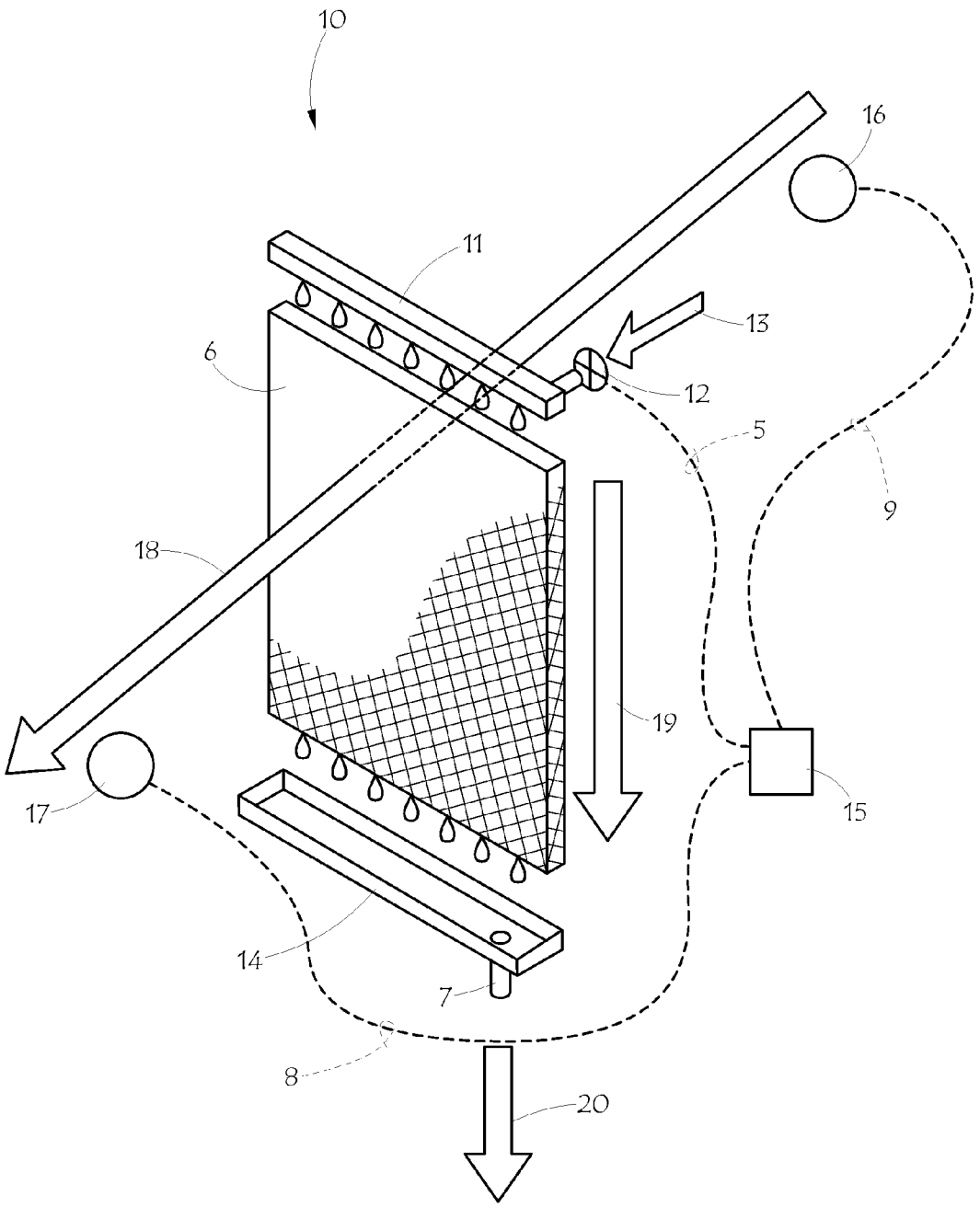
FIG. 1 is a schematic representation of an embodiment of the invention.

FIG. 1 is a schematic representation of an embodiment of the invention showing the key parts and their functional arrangement. In FIG. 1, air humidification system 10 includes evaporative pad 6, water fill system 11, drain system 14, and control system 15. Water fill system 11 is shown in the form a manifold that drips water onto the top pad 6. Water fill system 11 includes water control valve 12, and arrow 13 shows where a water supply can be connected to the valve and the direction of water flow into the system. Drain system 14 is shown as a tray with a drain 7. Arrow 19 shows the direction of flow of water down through pad 6 and arrow 20 shows the direction of flow of drain water out of drain 7. Drain 7 is shown as a nipple or pipe end to which a drain line could be attached as desired. Arrow 18 shows the direction of air flow through the pad, resulting in humidification of the air. Control system 15 is in communication with two input signals from upstream temperature sensor 16 and downstream temperature sensor 17, as indicated by input lines 9 and 8, respectively. Control system 15 transmits a control signal to water control valve 12 as indicated by output line 5. The control system computes the temperature drop in the air as it passes through the pad and then follows an algorithm to determine whether to turn the water valve on or off, resulting in a high humidification output and a low amount of drain water.

Figure 2:
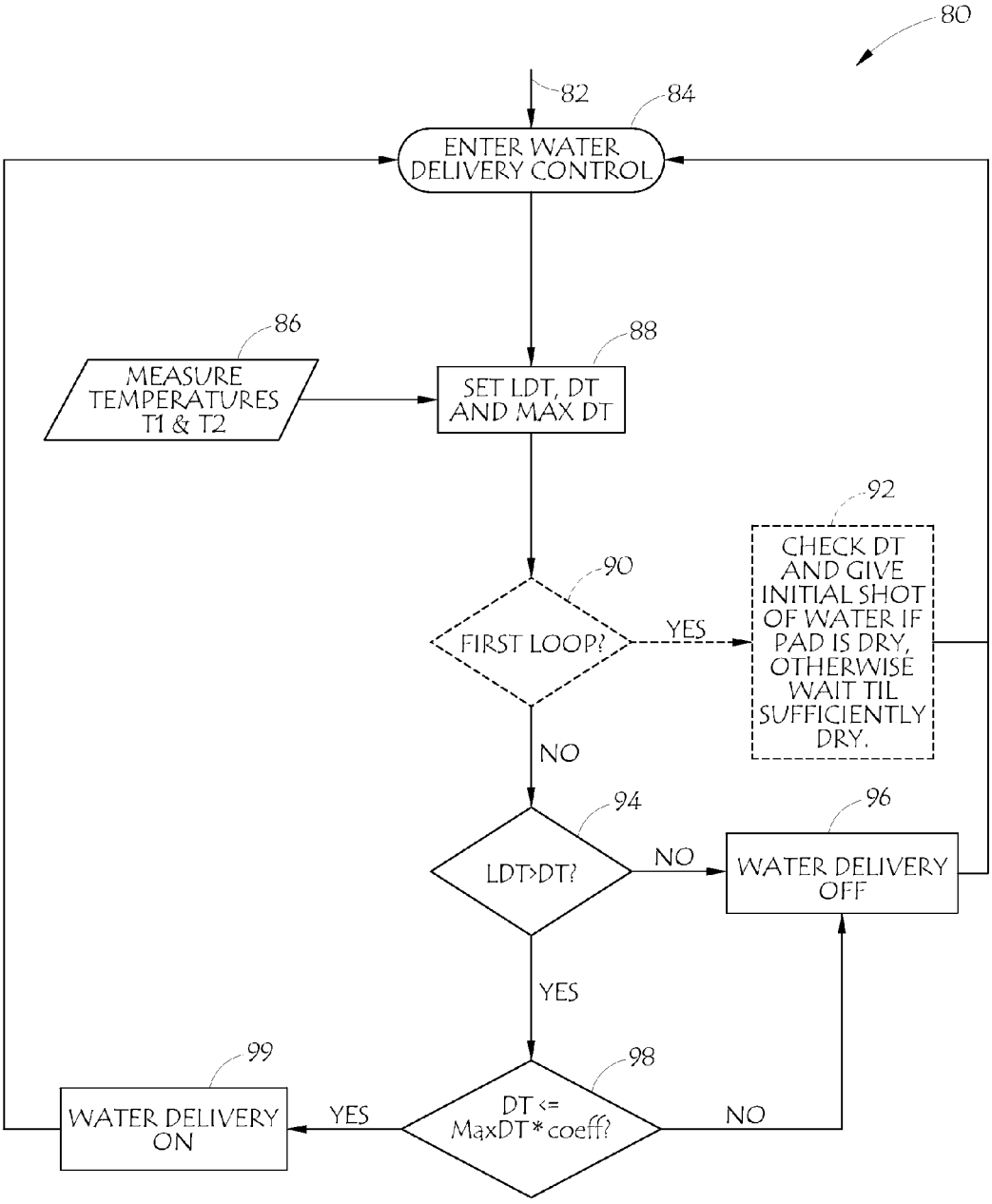
FIG. 2 is a flow chart according to an embodiment of the invention.

FIG. 2 is a flow chart of a water control method or program according to an embodiment of the invention. Water control method 80 would generally be part of, or connected to, an HVAC system controller which could include, for example, a humidistat, thermostat, fan and furnace controls, and/or the like as needed to operate the larger HVAC system. The method may be implemented in any suitable way known in the art, such as an analog control device, digital controller, circuit board, chip, computer program, etc. The water control program begins at 84 when a call for humidity is received from elsewhere (82).

Temperature inputs T1 and T2 are received from the upstream and downstream air temperature sensors, respectively, at input block 86. The controller then evaluates the temperature differential as temperature drop, DT=T1−T2, and keeps track of the previous value, LDT, at calculation block 88. The controller also checks to see if the maximum value of the temperature drop, MaxDT, recorded thus far during this call for humidity is exceeded by the current DT measurement, and if so updates MaxDT at calculation block 88.

Decision block 90 and action block 92 are an optional branch which may be implemented if desired in order to give the pad an initial shot of water on the first loop after a new call for humidity. Optionally, the first shot could continue for a number of loops, or as long as the value of DT indicates dry pad. Other optional checks may be included, such as a check to see if the pad might still be wet from a previous call for humidity.

Decision block 94 represents the controller determining whether the temperature drop is on the rise or falling. If the temperature drop is on the rise or flat, then LDT is not greater than DT and the water delivery is turned off or left in the off state at block 96. Then the control cycle is repeated from start block 84. If, on the other hand, the temperature drop is falling, i.e., LDT>DT, then a second decision block 98 is entered. In decision block 98, the controller checks whether the temperature drop is at or less than a predetermined fraction of the MaxDT, as determined thus far in the control cycle. The predetermined value of the fraction, i.e., the coefficient "COEFF" in block 98, may be set and or implemented as desired, e.g., permanently set in the controller, automatically determined by the controller, user selectable, or the like. It has been found that a single set value somewhere in the range 0.01 to 0.99 is sufficient to handle a wide but typical range of operating conditions and environments in which humidifiers are used. If the value of DT is less than or equal to MaxDT times COEFF, then the water delivery is turned on or left on if already on. Then the cycle repeats from start block 84. The control loop 80 thus repeats until a signal is received to end the call for humidity.

It should be understood that in the methods herein and in the claims, "opening" a valve also may mean commanding the valve to stay open if it is already open, or simply leaving it open. Likewise, closing the valve could mean remaining closed or not opening if the valve is already closed. It should also be understood that in the present context, "minimum" or "minimal" drain water is preferably non-zero in order to retain the benefits of a flow-through water delivery and drain system, including less deposit accumulation on the pad, less opportunity for molds or slimes to form, etc. Thus "minimum" refers to an acceptable, relatively low amount of drain water, not necessarily the absolute minimum possible level of drain water (which would generally be zero). On the other hand, "maximum output" does refer to the maximum possible amount of water evaporation into the air stream for the given totality of design and environmental conditions during a call for humidity. Also, the fraction represented by COEFF should be less than one (and positive) to accomplish the stated results herein.

Figure 3:
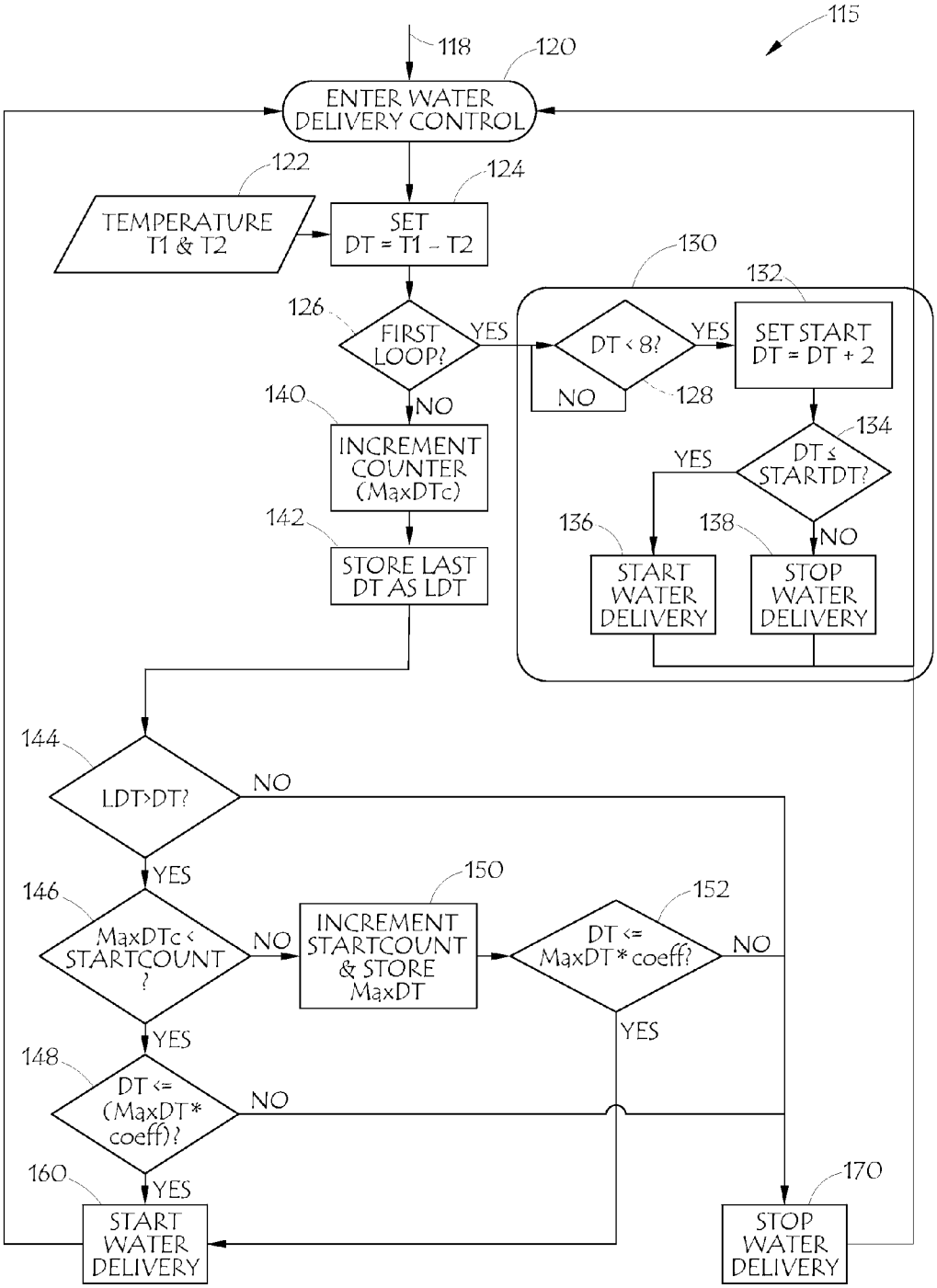
FIG. 3 is a more detailed flow chart of a specific control method according to an embodiment of the invention.

FIG. 3 is a more detailed flow chart of a water control method or program implemented according to an embodiment of the invention. Water control method 115 would generally be part of a HVAC system controller which could include, for example, a humidistat, thermostat, fan and furnace controls, and the like as needed to operate the larger HVAC system. The method may be implemented in any suitable way known in the art, such as a digital or analog controller, circuit board, chip, computer program, etc. The water control program begins at start block 120 upon call 118 for humidification received from a humidistat or a main HVAC control program. Temperature inputs T1 and T2 are received from the upstream and downstream temperature sensors, respectively, at input block 122. The temperature differential is represented as a temperature drop DT=T1−T2, so it is normally positive, and it is calculated at calculation block 124. At decision block 126, the program checks to see if this is the first loop since the call for humidity. The following first describes the startup cycle upon the initial call for water by a master control system, then the normal cycling during a prolonged call for water will be described.

On the first loop after a call for humidity, the program enters startup branch 130, which includes command block 136 which sends the signal to open the water control valve and start the flow of water onto the pad. The startup branch includes sufficient logic to accomplish this purpose. In the embodiment of FIG. 3, startup branch 130 includes a calculation block 132 which insures that decision block 134 will be "yes" or "true" and lead to the start water command at block 136. Block 138 is optionally included. Startup branch 130 may also optionally include a check such as decision block 128, which checks to see if DT is larger than a predetermined value, indicating the pad is still wet. Then the controller may wait for DT to drop before commanding the initial shot of water, or the controller may delay the startup loop before beginning normal cycling.

On the second and a number of subsequent initial loops predetermined by the value of StartCount, the controller continues to keep the water valve open unless the pad gets saturated with water. The embodiment of FIG. 3 does this as follows. First, the program increments counter MaxDTc at block 140 and stores the previous DT measurement as LDT at block 142, getting a new DT measurement and finally, comparing the new DT measurement to the previous LDT measurement at decision block 144. As long as LDT>DT at 144, the program will pass through 146 to 148 to 160 since MaxDTc is less than StartCount for these initial loops, and MaxDT is initially zero. If the LDT value is not greater than DT at decision block 144, then water delivery is stopped by block 170. In other words, if the temperature drop DT has stabilized or started to rise as a result of startup loop 130 and subsequent initial control loops, then sufficient water must be on the pad to begin to humidify the air, so the water control valve is shut in order to avoid wasting water.

Once the initial cycles are complete and the temperature drop across the pad begins to rise due to evaporative cooling of the air passing through the wet pad. The normal control cycles begin. The DT value is compared to the previous value LDT at block 144, as long as DT is rising or flat (indicating plenty of water on the pad), i.e., DT≥LDT, command block 170 will keep the water valve closed. Once the temperature drop starts falling or decreasing (indicating the pad is beginning to dry out), i.e., LDT>DT, the program branches down to decision block 146, which will now always be "NO" or "false," leading to blocks 150 and 152. The first time through this branch for each normal control cycle, the value of DT will have been at a peak, so calculation block 150 stores DT as the peak temperature differential, MaxDT. Then decision block 152 checks to see if DT has dropped to a predetermined fraction of MaxDT, given by MaxDT*DTM*COEFF, where DTM is an optional factor which can be chosen to limit the output capacity of the humidifier, and "COEFF" is a coefficient chosen to optimize the performance of the controller. In particular, COEFF determines how much below MaxDT DT has to fall before the decision at 152 is made to go to command block 160 and start the water flow again. If COEFF is 1 or too close to 1, then the water valve may turn on very frequently. If COEFF is too small, the humidity output into the air will be less than optimal.

Thus, during normal cycling while humidity is called for by the main controls or a humidistat, the water delivery controller shuts off the water valve whenever the temperature drop across the pad is rising or still near its peak temperature drop value. The water valve is then opened whenever the temperature drop falls below a predetermined percentage or fraction of the peak temperature drop. This cycle is repeated until there is no more call for humidity. By maintaining the operation of the humidifier near the peak temperature drop, it is ensured that the output of the humidifier is near its maximum. By cycling the water supply valve in this way, the valve will be closed a high percentage of the time, thus minimizing the drain water. However, this method also has been found to maintain some minimal flow of drain water so that the advantages of a flow-through system are maintained.

Some useful values of COEFF for the types of humidifiers described herein are in the range from 0.01 to 0.99, or from 0.1 or 0.95, or from 0.4 to 0.9, or from 0.7 to 0.95. Preferred values may be in the range from 0.4 to 0.99 for a range of typical temperature conditions for forced air, central HVAC applications, namely about 90-140° F. A single value of COEFF, such as about 0.75, 0.8, 0.85, 0.9, or 0.95 can give excellent results across the entire typical air duct temperature range of 90-140° F., and can handle a variety of installation situations. Note that a typical conventional system is generally evaluated or rated only at 120° F., and is not optimized for other conditions or for use in other situations. A typical standard for rating humidifiers is ANSI/AHRI Standard 610.

The second coefficient indicated in block 152, "DTM," is an optional factor which may be used for example to reduce the output capacity of the humidifier. For example, it has been found that if DTM=~0.5 the overall humidifier capacity of one example is reduced about 30%, and this reduces drain water as well. In effect, DTM*COEFF, works the same as a reduced value of COEFF, but may allow more controller functions or design options.

An advantage of this humidification control method, is that it a single control system setup works at any typical air temperature to optimize the output and minimize the drain water. Surprisingly, it has been found that this method produces approximately constant ratio of drain water to evaporative output regardless of operating air temperature. It is also able to produce these same results regardless of input water pressure or various other application variables. Although evaporative output will still degrade as the pad ages, the amount of drain water will also drop accordingly, as the controller still maintains the best output possible for that pad and maintains a relatively constant ratio of drain water to evaporative output.

Figure 4:
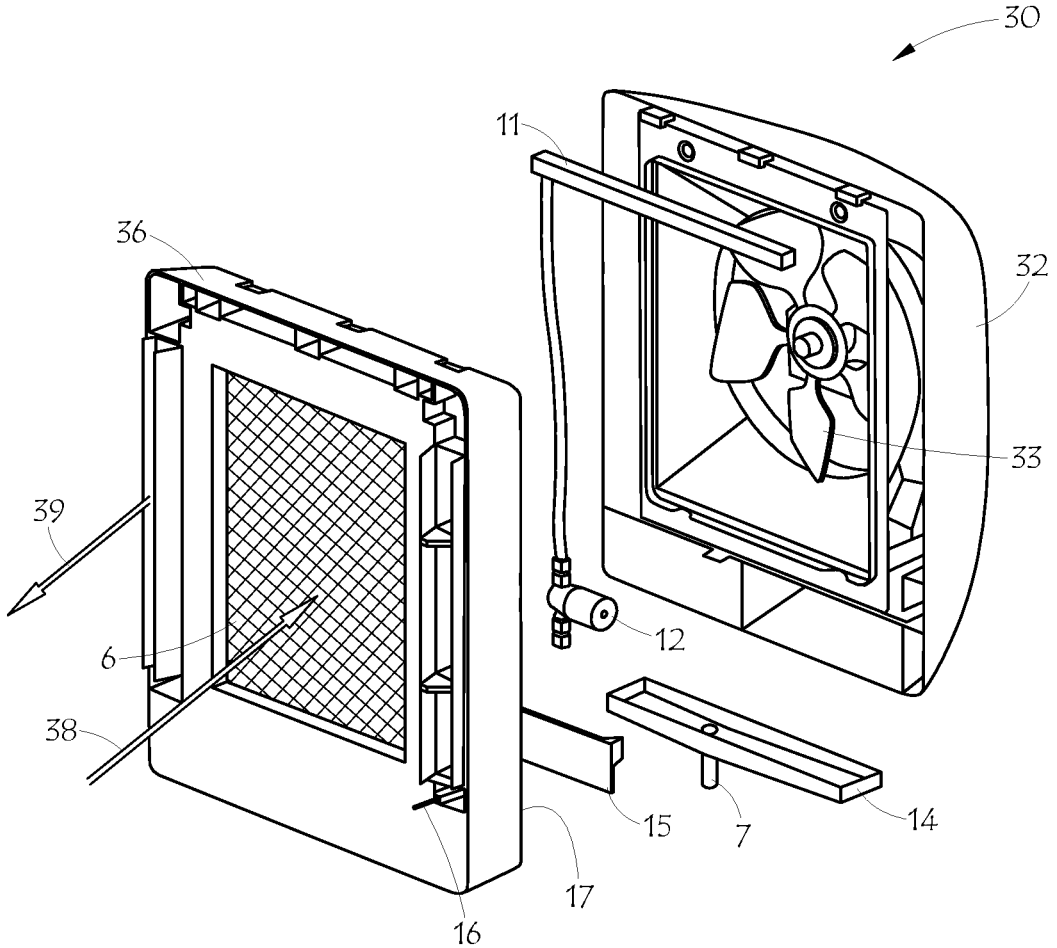
FIG. 4 is an exploded perspective view of an embodiment of the invention with a fan.

FIG. 4 is an exploded perspective view of an embodiment of the invention with a fan or blower to maintain air flow through the pad whenever called for. In FIG. 4, air humidification system (i.e., humidifier) 30 includes housing cover 32 and housing mounting base 36. Fan 33 is mounted in housing cover 32. When assembled the housing provides the air flow channels so that fan 33 pulls air into the housing through evaporative pad 6 as indicated by air inlet arrow 38, and out through the side passages as indicated by air outlet arrow 39. Water fill system 11 is again shown in the form a manifold that drips water onto the top of pad 6. Water fill system 11 includes water valve 12, where a water supply can be connected. Drain system 14 is again shown as a tray with drain 7. Drain 7 is again shown as a nipple or pipe end to which a drain line could be attached as desired. Control system 15 is again in communication with two input signals from upstream temperature sensor 16 and downstream temperature sensor 17, as well as with water control valve 12. The same control method described above in connection with FIG. 2 is implemented in control system 15.

Figure 5:
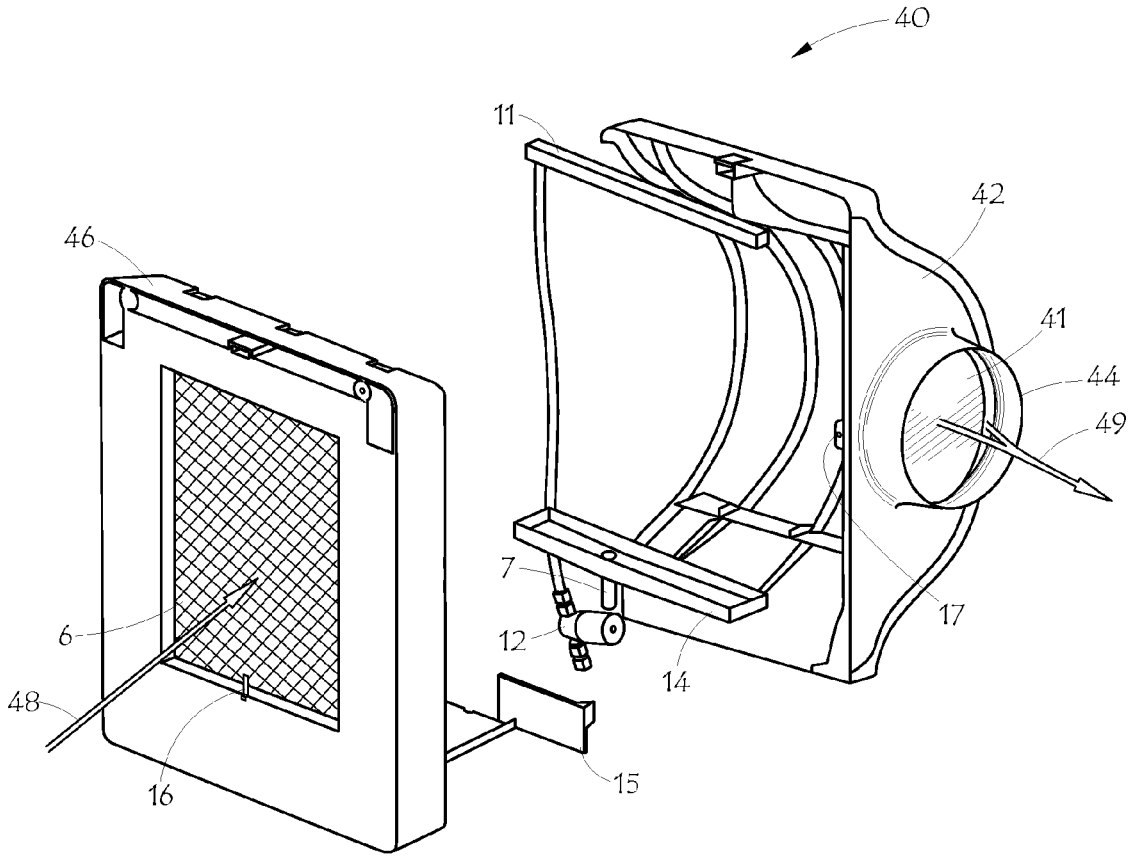
FIG. 5 is an exploded perspective view of a bypass embodiment of the invention.
Figure 6:
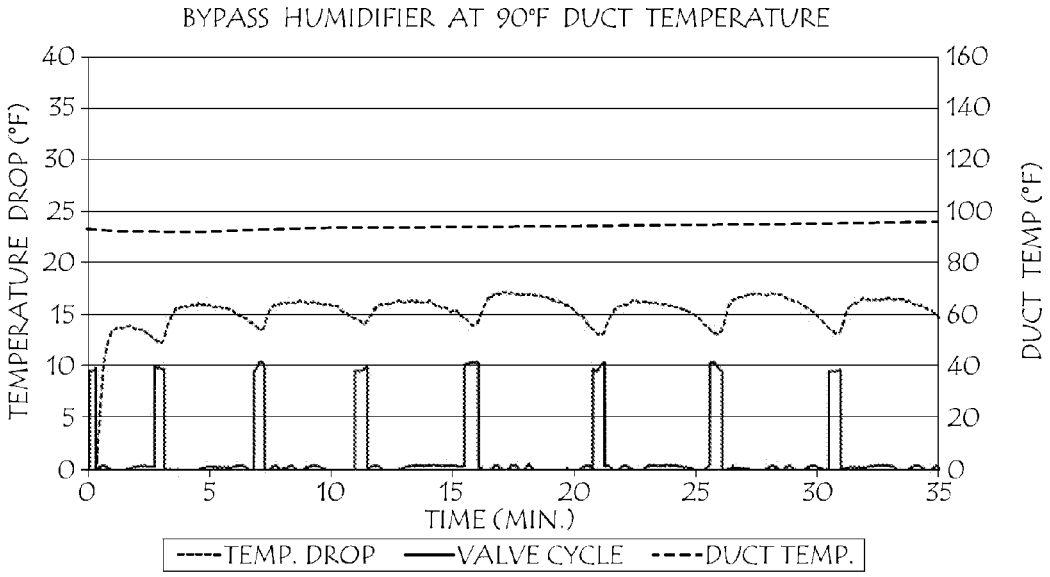
FIG. 6 is a graph of operational variables versus time for an embodiment of the invention under a set of operating conditions.
Figure 7:
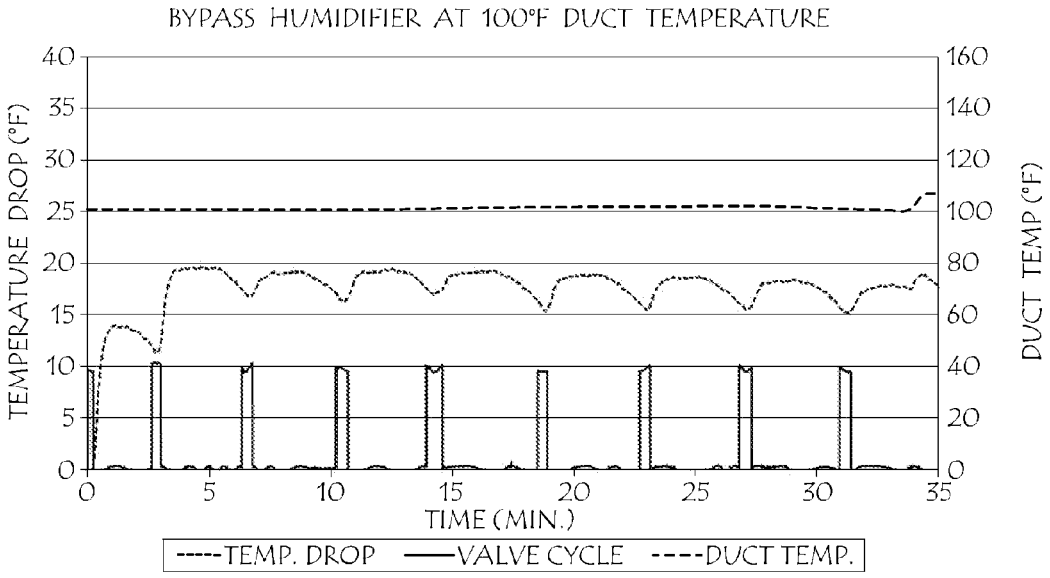
FIG. 7 is a graph of operational variables versus time for an embodiment of the invention under a second set of operating conditions.
Figure 8:
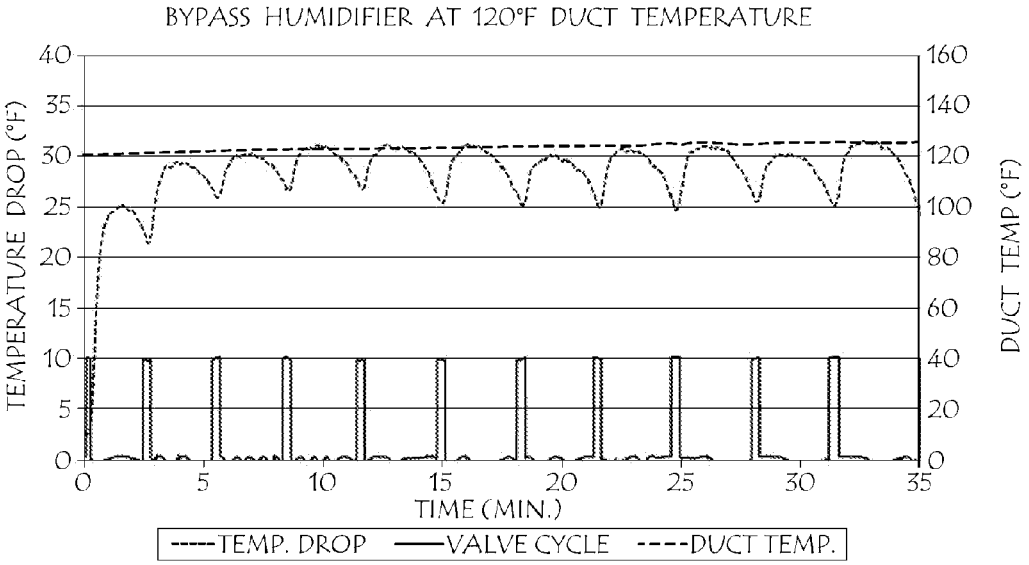
FIG. 8 is a graph of operational variables versus time for an embodiment of the invention under a third set of operating conditions.
Figure 9:
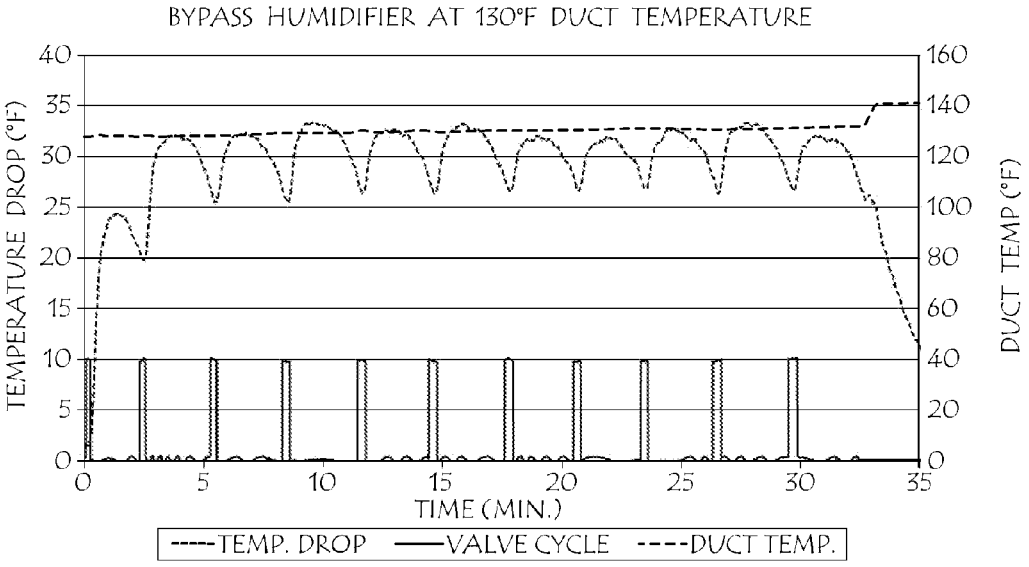
FIG. 9 is a graph of operational variables versus time for an embodiment of the invention under a fourth set of operating conditions.

FIG. 5 is an exploded perspective view of a bypass embodiment of the invention. In FIG. 5, air humidification system, i.e., bypass humidifier 40 includes housing cover 42 and housing mounting base 46. When assembled the housing provides the air flow pathway so that air from the HVAC system is drawn into the housing through evaporative pad 6 as indicated by air inlet arrow 48, and out through outlet duct 44 as indicated by air outlet arrow 49. Water fill system 11 is again shown in the form a manifold that drips water onto the top pad 6. Water fill system 11 includes water valve 12, where a water supply can be connected. Drain system 14 is again shown as a tray with a drain 7. Drain 7 is again shown as a nipple or pipe end to which a drain line could be attached as desired. Control system 15 is again in communication with two input signals from upstream temperature sensor 16 and downstream temperature sensor 17, as well as with water control valve 12. An embodiment of the same control method described above in connection with FIG. 2 is implemented in control system 15. Seasonal shut-off damper 41 may be supplied with bypass units in order to allow the user to effectively isolate the humidification system from the HVAC system if desired during the summer months or other times humidification is not used. An optional fan or blower may be included to allow the humidification system to self-supply warm air from the HVAC system through the evaporator pad.

Numerous variations on the embodiments described above are possible and within the scope of the invention. Embodiments may have any desirable capacity or size of unit, any suitable number, shape and/or configuration of evaporator pads, any suitable temperature sensor type or location, any suitable fan size, or the like. The same controller with the same parameters works equally well a wide range of designs, including for bypass humidifiers and for humidifiers with fans or blowers.

The water control method can be implemented in various ways, as long as the basic principles are followed. The short shot of water in the start loop could be put on a timer instead of using a number of loops (StartCount) to start it. Decision block 152 could be replaced by a sequence of two or more decision blocks with different coefficients for different operating scenarios. For example, there could be different coefficients ("COEFF1", "COEFF2", . . . ) for different temperature ranges, or for different types of pads, or for multi-speed furnaces, or for whatever might require or benefit from an adjustment of the controller settings. The coefficient(s) could be calculated or adjusted continuously by a smart controller to optimize output and drain water for changing conditions or for different goals. However, it has been found that the performance of this control program is remarkably consistent over a wide range of conditions with the same parameters, as illustrated by the examples below. The startup of the control sequence could also be delayed if the air temperature in the HVAC duct on which said air humidifier is mounted is below a predetermined or set value.

Of course, the housing can be constructed in any way which provides the desired flow path and mounting capability for the pad, water system, drain, controller, and sensors, and for optional features such as fan, damper, filter, and the like. It can conveniently be molded from plastic. The evaporative pad can be of any suitable design such as fibrous pads, paper-based pads, open-cell foams, expanded metals with absorbent coatings, and the like. Examples of useful pads constructed with wicking paper and kraft paper are disclosed in U.S. Pat. No. 6,000,684 to Pasch et al. A particularly useful pad having high evaporation output is one with a diatomaceous earth coating on an aluminum mesh.

An air humidification system according to an embodiment of the invention, which directly monitors the air temperature before and after the evaporator pad, has the ability to overcome the problems and weaknesses previously described in the background above. By actively monitoring the system conditions with the two temperature sensors, the humidification system can cycle the water supply to the evaporator pad ensuring a maximized humidification capacity for a given HVAC system and minimized or optimized water drainage from the humidifier at the same time. The temperature sensors allow the control system to recognize when the heat source is operating, how much evaporation is taking place, and whether to add more water to the humidifier pad. This information gives the humidification system described in FIG. 3 the ability to recognize whether the pad is dry or sufficiently wet. For example, decision block 128 identifies a wet pad condition and prevents the initial startup shot.

Another advantage is the air humidification system's ability, at the beginning of each humidification cycle; to automatically delay water delivery if the pad is still wet and to automatically calibrate itself to the immediate conditions of the system. This calibration gives the humidification system the ability to achieve and maintain an optimum output capacity relative to the immediate conditions of the HVAC system during that humidification cycle, e.g. over the entire range of typical operating temperatures of 90 to 140° F. The calibration may be repeated for each subsequent humidification cycle. Dirty air filters, which would reduce the warm air flow across the humidifier, thus reducing the output capacity of a conventional humidifier and resulting in increased waste water, are now met with automatically adjusted water delivery to maintain a maximum output potential while continuing to minimize or optimize waste drain water. Likewise, different pad types, with different capacities are automatically accommodated. In a system that employs a lower temperature heating source, such as a heat pump (typical air temperatures range from 90 to 120° F.), the temperature sensors continue to allow the control system to cycle the supply water, but retain the ability to maximize capacity while minimizing drain water. The optional addition of a fan or blower to the humidification system allows the air humidification system to be applicable to all installation conditions.

Illustration A.

The examples of Illustration A focus on showing the water flow rates of a conventional humidifier versus an inventive humidifier. Table 1 compares a conventional humidifier, Comparative Example 1(Comp. Ex. 1), with two embodiments of the present invention, Ex. 2 and Ex. 3.

Comp. Ex. 1 uses a constant time pulse to reduce the amount of time that a water supply valve remains open during a call for humidity. The time pulse is set to provide maximum output of water into the air. The output is dependent on the air temperature. Thus, the output capacity in gallons per day ("GPD") increases as the air temperature increases. However, the constant pulse cycle results in constant total water flow, so the amount of water going down the drain is much higher for the lower air temperatures. This illustrates how the constant flow approach is inherently inefficient, since it can only be optimum at a single air temperature. If optimized at 120° F. for high output and low drain water, then at lower temperatures, much more water will be wasted than desirable, while at higher temperatures, all the water may be evaporated and the output may be less than should be possible.

On the other hand, Ex. 2, a by-pass humidifier resembling the embodiment of FIG. 5, uses an implementation of the water delivery control method of FIG. 2 and FIG. 3. The superior performance of the inventive Ex. 2 is also illustrated by Table 1. Ex. 2 exhibits a drain flow that is generally proportional to the output capacity independent of the air temperature. Likewise the total flow is proportional to the output capacity at any air temperature. As a result, the output capacity is always optimal and the drain to output ratio is always about the same. The total flow can therefore be set much lower than in the Comp. Ex. 1, and the drain water rate will always be less than for Comp. Ex. 1. Note that the rated capacity of the Ex. 2 is 18 GPD, 50% more than Comp. Ex. 1, even though the amount of drain water is much less than Comp. Ex. 1. For the inventive Ex. 2, lower air temperatures result in lower drain water rates, just the opposite of the trend for Comp. Ex. 1.

Ex. 3 uses a second embodiment of the method of FIG. 2 and FIG. 3, tuned for even more water savings, i.e., lower drain water rates. Again the output capacity is temperature dependent, but so is the drain rate, so the ratio of drain to output stays relatively constant. Note that some of these runs were conducted with different values of COEFF, but all were in the range from 0.75 to 0.9.

Illustration B.

A second set of experiments was carried out to illustrate how the water delivery controller functions according to an embodiment of the invention. In these experiments a by-pass humidifier resembling the embodiment of FIG. 5 was fitted with a controller based on FIG. 2 and FIG. 3 and tuned by selecting "COEFF" in block 152 to give a drain water to output ratio less than one, i.e., similar to Ex. 3 above. The value of COEFF=0.9. The upstream air temperature in the main duct was measured versus time as the duct temperature, along with the temperature drop across the pad (T1−T2). The valve status, on or off, open or closed, is indicated by the voltage signal to the valve from the controller. The results are graphed in FIG's 6-10 for five different duct air temperature settings. The valve state indicated in the graph is the voltage scaled times three for ease of viewing on the graph. In each figure, a thirty-five minute control cycle is reported.

TABLE 1

| | Air Temp. | Output Capacity (GPD) | Drain Water (GPD) | Total Flow (GPD) | Drain Water Ratio |
|---|---|---|---|---|---|
| Comp. Ex. 1 | 140° F. | 13.9 | 48.0 | 61.9 | 3.4 |
| Constant Time Pulse | 120° F. | 11.7 | 50.2 | 61.9 | 4.3 |
| Humidifier | 100° F. | 8.9 | 53.1 | 62.0 | 6.0 |
| (12 GPD)[1,2] | 90° F. | 7.5 | 54.2 | 61.7 | 7.3 |
| Ex. 2 (18 GPD) | 140° F. | 21.1 | 35.3 | 56.4 | 1.7 |
| | 120° F. | 14.6 | 29.2 | 43.7 | 2.0 |
| | 100° F. | 10.4 | 25.0 | 35.4 | 2.4 |
| | 90° F. | 9.1 | 19.2 | 28.2 | 2.1 |
| Ex. 3 (18 GPD) | 140° F. | 21.8 | 15.7 | 37.5 | 0.72 |
| | 130° F. | 19.8 | 16.8 | 36.7 | 0.85 |
| | 120° F. | 16.9 | 8.9 | 25.8 | 0.53 |
| | 110° F. | 15.8 | 10.6 | 26.3 | 0.67 |
| | 100° F. | 14.5 | 12.0 | 26.6 | 0.83 |
| | 90° F. | 13.0 | 12.3 | 25.3 | 0.95 |

[1]GPD = gallons per day
[2]1 day = 24 hours

FIG's 6-10 illustrate a number of features of the invention. The temperature drop across the evaporative pad responds quickly when the water valve is opened. The valve need not open for very long before the temperature drop begins to increase and the valve can then be closed. It should be understood that there is no timing step or time measurement or timing function involved in the control method. The valve control is strictly in response to two measured temperatures, i.e., the temperature differential across the pad. One could optionally implement a secondary control feature based on the rate of change of the temperature differential, (e.g. an integral or differential control function), but such a use of time is secondary to the primary function of controlling temperature drop. Thus, the present invention is fundamentally different from conventional approaches which directly control water valve timing or duty cycle to reduce water use. Moreover, the experiments show that more complicated control schemes, which might involve time-based calculations, derivatives or integrals, are simply not necessary to achieve a low amount of drain water over a wide range of operating conditions. The controller design can therefore be kept very simple.

Figure 10:
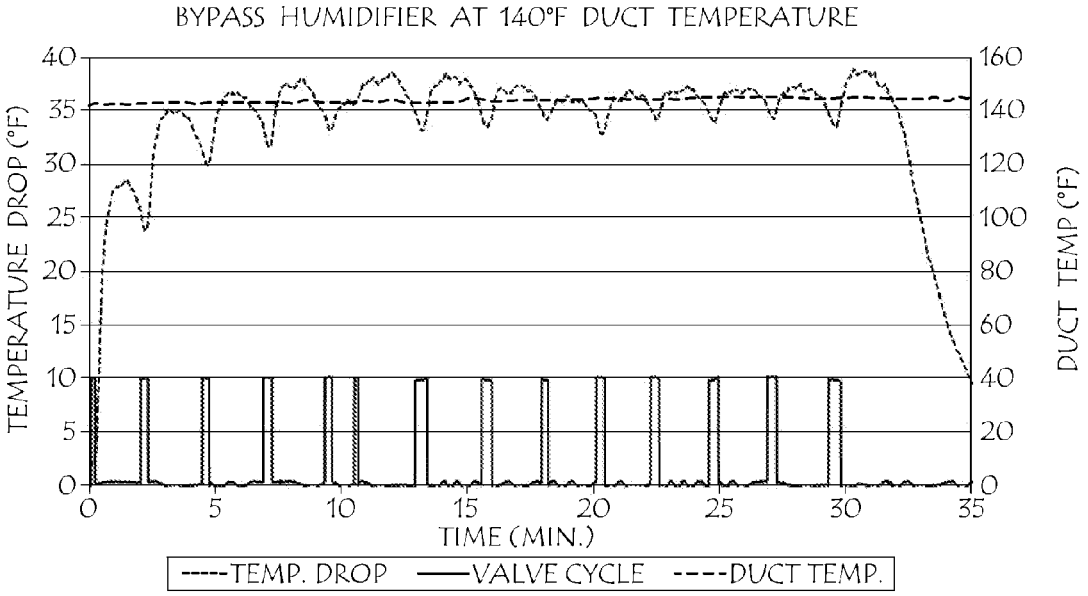
FIG. 10 is a graph of operational variables versus time for an embodiment of the invention under a fifth set of operating conditions.

Another feature of the invention shown by FIG's 6-10 is that the controller quickly finds the maximum temperature drop, generally on the second valve cycle. At the highest duct temperature, i.e., at 140° F. in FIG. 10, more valve cycles may be required to reach the maximum temperature drop. It should be understood that the maximum temperature drop is actually determined by the controller each time there is a call for humidity. Therefore, the controller succeeds in the goals of maximum output and minimum drain water regardless of the details of the design of the humidifier, or the condition of the pad, or the water pressure or other details of the particular HVAC application in which the controller is installed.

It can be seen from FIG's 6-10 that the controller adjusts automatically for the five different duct temperatures. The higher duct temperatures call for more output, so the controller naturally supplies more water to the pad. At higher duct temperatures, the pad dries out faster when the water is off, so the controller automatically responds with more valve openings during the 35-minute run. Again, this is a dramatic difference from the conventional controls which are tuned to one particular duct temperature condition. Those conventional controllers will inherently generate increasing drain water as the duct temperature drops or as the pad degrades in output efficiency. The inventive control method automatically handles all such changes in conditions.

Although the present invention and its advantages have been described in detail, it should be understood that various changes, substitutions, and alterations can be made herein without departing from the spirit and scope of the invention as defined by the appended claims. Moreover, the scope of the present application is not intended to be limited to the particular embodiments of the process, machine, manufacture, composition of matter, means, methods, and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps. The invention disclosed herein may suitably be practiced in the absence of any element that is not specifically disclosed herein.

What is claimed is:

1. A humidifier comprising:

an evaporator pad, a water delivery valve, a first temperature sensor upstream of said evaporator pad, a second temperature sensor downstream of said evaporator pad, and a water delivery controller which:

monitors the temperature drop of an air flow across the evaporative pad;

determines whether said temperature drop is increasing or decreasing;

determines the maximum temperature drop thus far during a call for humidity;

opens said valve when said temperature drop is decreasing and is less than or equal to a predetermined fraction of said maximum temperature drop thus far; and closes said valve when said temperature drop is increasing.

2. The humidifier of claim 1 further comprising a drain disposed between a housing cover and a housing mounting base; the pad disposed within the housing mounting base; wherein said valve delivers water to said pad through a water delivery system; and said drain continually removes excess water flowing off of said pad.

3. The humidifier of claim 1 wherein said predetermined fraction is in the range from 0.01 to 0.99.

4. The humidifier of claim 1 wherein said predetermined fraction is in the range from 0.4 to 0.95.

5. The humidifier of claim 1 wherein said controller further comprises more than one predetermined fraction, each said fraction active during a different set of operating conditions.

6. The humidifier of claim 1 wherein said controller further automatically adjusts said predetermined fraction for different operating conditions.

7. The humidifier of claim 1 wherein said controller at startup delays a first opening of said valve if said pad is already wet.

8. An air humidification system comprising:

a housing, an evaporator pad, a water delivery system with a water control valve, a drain system, an upstream temperature sensor, a downstream temperature sensor, and a controller; wherein said controller:

monitors the temperature drop of an air flow across the evaporative pad;

determines whether said temperature drop is increasing or decreasing;

determines the maximum temperature drop thus far during a call for humidity;

opens said valve when said temperature drop is decreasing and is less than or equal to a predetermined fraction of said maximum temperature drop thus far; and closes said valve when said temperature drop is increasing.

9. The air humidification system of claim 8 wherein said predetermined fraction is in the range from 0.01 to 0.99.

10. The air humidification system of claim 8 wherein said predetermined fraction is in the range from 0.4 to 0.95.

11. The air humidification system of claim 8 wherein said evaporator pad, said a water delivery system with said water control valve, said drain system, said upstream temperature sensor, said downstream temperature sensor, and said controller are mounted in said housing;

said housing is adapted to direct an air flow through said pad;

said valve delivers water to said pad through said water delivery system; and said drain system continually removes excess water flowing off of said pad.

12. The air humidification system of claim 8 wherein the housing comprises a housing mounting base coupled to a housing cover.

13. A method of controlling water delivery to an evaporative pad in an air humidifier comprising:

during a call for humidity:

monitoring the temperature drop of the air flow across said evaporative pad;

determining whether said temperature drop is increasing or decreasing;

determining the maximum temperature drop thus far during said call for humidity;

opening a control valve which supplies water to said pad when said temperature drop is decreasing and is less than or equal to a predetermined fraction of said maximum temperature drop; and closing said control valve when said temperature drop is increasing.

14. The method of claim 13 wherein said predetermined fraction is in the range from 0.01 to 0.99.

15. The method of claim 13 further comprising at the beginning of said call for humidity, delaying the opening of said control valve if said temperature drop indicates said pad is already wet.

16. The method of claim 13 further comprising at the beginning of said call for humidity, delaying the opening of said control valve if the air temperature in a duct on which said air humidifier is mounted is below a predetermined value.

17. The method of claim 13 further comprising adjusting said predetermined fraction in response to a change in an operating condition while said air humidifier is running.

18. The method of claim 13 further comprising adjusting said predetermined fraction in response to a change a startup condition.

19. The method of claim 13 further comprising changing said predetermined fraction to adjust the output capacity of the air humidifier.

20. The air humidification system of claim 9 wherein the housing comprises:

a housing cover;

a fan disposed within the housing cover; and a housing mounting base coupled to the housing cover, wherein the evaporator pad is disposed within the housing mounting base.

* * * * *